US006143160A

United States Patent [19]

Diaddario, Jr.

[11] Patent Number: 6,143,160

[45] Date of Patent: Nov. 7, 2000

[54] METHOD FOR IMPROVING THE MACRO THROWING POWER FOR CHLORIDE ZINC ELECTROPLATING BATHS

[75] Inventor: Leonard L. Diaddario, Jr., Independence, Ohio

[73] Assignee: Pavco, Inc., Cleveland, Ohio

[21] Appl. No.: 09/156,859

[22] Filed: Sep. 18, 1998

[51] Int. Cl.[7] ..... C25D 3/22

[52] U.S. Cl. ..... 205/311; 205/314; 205/214; 106/1.29

[58] Field of Search ..... 205/311, 314, 205/244; 106/1.29

[56] References Cited

U.S. PATENT DOCUMENTS

| | | | |
|---|---|---|---|
| 1,988,575 | 1/1935 | Schmidt | 260/11 |
| 1,988,576 | 1/1935 | Schmidt | 260/11 |
| 3,655,534 | 4/1972 | Kampe | 204/55 R |
| 3,840,444 | 10/1974 | Koch | 204/55 R |
| 3,849,325 | 11/1974 | Kampe | 204/55 |
| 3,853,718 | 12/1974 | Creutz | 204/55 R |
| 3,869,358 | 3/1975 | Nobel et al. | 204/55 R |
| 3,871,974 | 3/1975 | Duchene et al. | 204/55 R |
| 3,884,774 | 5/1975 | Kessler | 204/55 R |
| 3,957,595 | 5/1976 | DuBrow et al. | 204/55 R |
| 4,022,676 | 5/1977 | Popescu | 204/55 R |
| 4,045,306 | 8/1977 | Senge et al. | 204/55 R |
| 4,071,419 | 1/1978 | James | 204/55 R |
| 4,075,066 | 2/1978 | Eckles et al. | 204/55 R |
| 4,076,600 | 2/1978 | Huebner | 204/55 R |
| 4,081,336 | 3/1978 | Eppensteiner et al. | 204/55 R |
| 4,089,755 | 5/1978 | Steinecker | 204/55 R |
| 4,104,137 | 8/1978 | Lash et al. . | |
| 4,113,583 | 9/1978 | Oshima et al. | 204/55 R |
| 4,119,502 | 10/1978 | Arcilesi | 204/55 R |
| 4,134,804 | 1/1979 | Zehnder et al. | 204/55 R |
| 4,135,992 | 1/1979 | Fikentscher et al. | 204/55 R |
| 4,137,133 | 1/1979 | Arcilesi | 205/314 |
| 4,146,442 | 3/1979 | McFarland | 204/55 R |
| 4,157,388 | 6/1979 | Christiansen | 424/70 |
| 4,159,926 | 7/1979 | Barnes et al. . | |
| 4,162,947 | 7/1979 | Canaris | 204/55 R |
| 4,166,778 | 9/1979 | Acimovic et al. | 204/55 R |
| 4,169,771 | 10/1979 | Creutz et al. | 204/55 R |
| 4,169,772 | 10/1979 | Lowery et al. | 204/55 R |
| 4,222,829 | 9/1980 | Popescu | 204/55 R |
| 4,229,267 | 10/1980 | Steinecker | 204/55 R |
| 4,229,268 | 10/1980 | Lowery et al. | 204/55 R |
| 4,251,331 | 2/1981 | Rosenberg | 204/55 R |
| 4,252,619 | 2/1981 | DaFonte, Jr. et al. | 204/55 R |
| 4,397,717 | 8/1983 | Acimovic et al. | 204/55 R |
| 4,401,526 | 8/1983 | Martin | 204/43 Z |
| 4,405,413 | 9/1983 | Skimin | 204/55 R |
| 4,422,908 | 12/1983 | Welch | 204/55 R |
| 4,425,198 | 1/1984 | Martin | 204/43 Z |
| 4,441,969 | 4/1984 | Tremmel . | |
| 4,444,629 | 4/1984 | Martin | 204/43 Z |
| 4,444,630 | 4/1984 | Steinecker | 204/55 R |
| 4,488,942 | 12/1984 | Martin et al. | 204/55 R |
| 4,496,439 | 1/1985 | Greif et al. | 204/55 R |
| 4,512,856 | 4/1985 | Paneccasio | 204/55 R |
| 4,540,472 | 9/1985 | Johnson et al. . | |
| 4,581,110 | 4/1986 | Tsuchida et al. | 204/44.2 |
| 4,717,458 | 1/1988 | Martin et al. | 204/44.2 |
| 4,730,022 | 3/1988 | Willis | 204/55.1 |
| 4,792,383 | 12/1988 | Willis | 204/55.3 |
| 4,861,442 | 8/1989 | Nishihama et al. | 204/44.2 |
| 4,923,575 | 5/1990 | Voss et al. | 204/44.2 |
| 4,969,980 | 11/1990 | Yoshioka et al. | 204/28 |
| 4,983,263 | 1/1991 | Yasuda et al. | 204/44.2 |
| 5,182,006 | 1/1993 | Haydu et al. | 205/213 |
| 5,194,140 | 3/1993 | Dobrovolskis et al. | 205/245 |
| 5,200,057 | 4/1993 | Canaris | 205/245 |
| 5,435,898 | 7/1995 | Commander et al. | 205/245 |

FOREIGN PATENT DOCUMENTS

WO 97/14826 4/1997 WIPO .

*Primary Examiner*—Kishor Mayekar
*Attorney, Agent, or Firm*—Fay, Sharpe, Fagan, Minnich, McKee, LLP

[57] ABSTRACT

An aqueous acid plating bath for the electro-deposition of a zinc or zinc alloy deposit on a substrate which includes zinc ions and an additive of the general formula

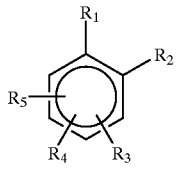

wherein $R_1$ and $R_2$ are selected from the following functional groups hydroxyl, carbonyl, carboxylic acid or its salt; $R_3$ is selected from the following groups hydrogen, hydroxyl, carbonyl, carboxylic acid or its salts; $R_4$ and $R_5$ are electron withdrawing groups, such as but not totally inclusive, halides, sulfonic acid or its salts, triflouromethyl, cyano, and amino groups.

15 Claims, No Drawings

METHOD FOR IMPROVING THE MACRO THROWING POWER FOR CHLORIDE ZINC ELECTROPLATING BATHS

Field of the Invention

The present invention relates to aqueous acid zinc electroplating solutions and a method for electroplating zinc coatings. More particularly, this invention relates to an acid zinc electroplating solution including a unique additive which increases macro throwing power.

Background of the Invention

Considerable attention has been directed to providing improved corrosion protection to metallic surfaces. One way of providing corrosion protection is by electro-depositing a zinc or zinc alloy coating on the surface. The term "alloy" is used in the specification and claims as defined as a mixture of two or more metallic elements which may be microscopically homogenous or microscopically heterogenous. For decades, electroplated zinc has been used to provide economical, highly corrosion resistant coatings.

Traditionally, cyanide has formed a primary component of zinc plating baths. However, in light of the hazardous nature of cyanide, activity in the plating area has been concentrated on the development of cyanide-free alkaline baths or acid baths.

One approach has involved the utilization of alkaline solutions containing the alkali metal pyrophosphates in combination with complex zinc compounds. The use of such phosphates, however, has created disposal problems since these phosphate compositions are difficult to remove from aqueous wastes, particularly when they are present in the concentrations required to achieve commercially satisfactory plating processes. Furthermore, electroplating zinc processes employing pyrophosphate baths can result in relatively poor low current density coverage, roughness, insufficient brightness and non-uniform deposits.

Typically, acid zinc plating baths are based on a suitable inorganic zinc salt such as zinc chloride or zinc sulfate, and the baths usually include buffers such as ammonium salts or boric acid. Additives are often included in the baths to promote and improve ductility, brightness, throwing power and covering power. Surface active agents may also be included to improve crystal structure, reduce pitting, and increase the effectiveness of other additives.

Additives can be generally characterized as falling into three general categories which can be identified as primary type additives or carriers, secondary type additives or brighteners and auxiliary additives. The primary type additives are present in the bath in higher concentrations than the secondary type auxiliary additives and generally function to provide grain refining and throwing power. Certain of these primary type additives also have hydrotropic properties which function to keep the secondary type additives or brighteners in solution. The secondary type additives generally function in the bath to provide luster or brightness to the deposit. In some instances, secondary additives also provide improved throwing power. The auxiliary additives, among other things, are intended to widen the brightness range and may also assist in solubilizing the secondary additives. It will, of course, be appreciated that individual additives may, to a greater or lesser extent, function in more than one of the above-described capacities, particularly if used in excess quantities.

A variety of exemplary additives for acid zinc plating baths have been identified in the patent literature. For example, U.S. Pat. No. 4,075,066 discloses that bright, level and ductile zinc deposits can be obtained in baths which are free of ammonia or amines by including at least one polyoxy alkylated napthol, at least one aromatic carboxylic acid or soluble salt thereof and at least one ionic aromatic sulfonic acid or soluble salt thereof. U.S. Pat. No. 4,076,600 discloses that bright and level zinc electro-deposits can be obtained from aqueous acid plating baths wherein the bath contains a phosphorous cation delivered on a particular hydrocarbon molecule. U.S. Pat. No. 4,089,755 teaches that bright, fine grain zinc deposits over a broad current density range can be produced in an aqueous bath by including a primary additive or carrier component which comprises a cationic quaternary ammonium surfactant. U.S. Pat. No. 4,162,947 discloses an acid zinc plating bath and a method of obtaining bright and level zinc electro-deposits over a wide current density range by including at least one aromatic sulfonic acid or salt U.S. Pat. No. 4,405,413 discloses an acid zinc plating bath which will give a deposit having decreased susceptibility to blush achieved by including a surfactant comprised of a blend of at least two carboxy-terminated long chain alkyl phenols. U.S. Pat. No. 4,422,908 is directed to an aqueous zinc electroplating bath wherein an organic salt of an alkaline metal and inorganic acid complexing agent selected from a group consisting of benzoic acid, cenamic acid, nicotinic acid and 2-furylacrylic acid are added to the bath.

U.S. Pat. No. 4,425,198 is directed to a zinc alloy electroplating bath incorporating zinc and nickel and/or cobalt ions in a brightening agent, the brightening agent being selected from the group consisting of homopolymer of acrylamide, a homopolymer of an N-substituted acrylamide and a copolymer of an acrylamide and an N-substituted acrylamide and/or a solubilizing agent selected from a group consisting of methacrylic acid, acrylic acid, acrylonitrile, methacrylonitrile, vinyl $C_1$–$C_5$ alkyl esters, vinyl halide, epihalohydrin, vinylidine halide, alkylene oxide and mixtures thereof.

U.S. Pat. No. 4, 496,439 is directed to an aqueous acid plating bath for the electrolytic deposition of zinc which contains conductive salts, brighteners, and surfactants U.S. Pat. No. 4,512,856 is directed to an aqueous acid zinc plating solution for electro-deposition of zinc coatings utilizing a grain refining agent comprising a non-surfactant substitute polyhydric alcohol having three or more ethoxylated and/or propoxylated hydroxyl groups.

U.S. Pat. No. 5,200,057 is directed to an additive composition for a zinc plating bath, the additive composition comprising a mixture of poly (N-vinyl-2-pyrolidone) and at least one sulfur containing compound.

It is well known that bright and lustrous metallic zinc deposits can be electroplated on a metallic substrate from aqueous acid zinc plating solutions or baths. However, difficulties persist in commercially producing uniform and reliable zinc coatings of sufficiently high levels of brightness and luster, and most particularly, uniform thickness. Moreover, without an additive to increase macro throwing power, the zinc coatings produced by conventional baths may not exhibit uniformly smooth and refined surfaces over the full range of current densities normally encountered in commercial applications.

Notwithstanding all of their previously developed additives which improve the qualities of coatings produced by an acid zinc electroplating bath, the macro throwing power of a mildly acidic bath has typically been unsatisfactory for parts having complex shapes. Accordingly, it is desirable in this art to develop an additive for an acid zinc chloride plating bath that will achieve improved macro throwing power.

SUMMARY OF THE INVENTION

Accordingly it is a primary advantage of this invention to provide a new and improved additive for an acid zinc chloride plating bath. It is a further object of this invention to provide a new and improved additive for an acid zinc chloride plating bath which improves the macro throwing power of the bath. Additional objects and advantages of the invention will be set forth in part in the description which follows and in part will be obvious from the description or may be learned by practice of the invention. The objects and advantages of the invention may be realized and attained by means of the instrumentalities and combinations particularly pointed out in the appended claims.

To achieve the foregoing objects, and in accordance with the purpose of the invention, as embodied and broadly described herein, the additive in the form of an aromatic hydrocarbon including carboxyl or hydroxl groups in an ortho position. Preferably, the additive of the present invention is characterized by the following general formula

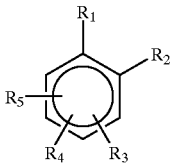

wherein $R_1$ and $R_2$ are selected from the following functional groups hydroxyl, carbonyl, carboxylic acid or its salt; $R_3$ is selected from the following groups hydrogen, hydroxyl, carbonyl, carboxylic acid or its salts; $R_4$ and $R_5$ are electron withdrawing groups, such as but not limited to halides, sulfonic acid or its salts, triflouromethyl, cyano, and amino groups.

DETAILED DESCRIPTION OF THE INVENTION

The aqueous acid zinc plating baths to which the present inventive additive is suitable include conventional zinc and ammonium or boric acid containing plating baths known to those skilled in the art. Such baths contain free zinc ions. Typically, zinc sulfate, zinc chloride, zinc floroborate and/or zinc sulfamate will provide the source of the zinc ions. The electroplating baths may be employed in all types of industrial zinc plating processes such rack plating baths, high speed plating baths for strip or wire plating, and barrel plating.

Zinc plating baths typically also contain an ammonium compound in the form of ammonium chloride, ammonium fluoride or ammonium sulfate. Other conducting salts may also be used. Examples of conductive salts utilized in the acid zinc plating baths of the invention include sodium chloride, sodium borate and potassium chloride, sodium sulfate, potassium sulfate, ammonium chloride or sulfate, sodium, potassium or ammonium fluoroborate, sodium potassium or ammonium sulfate, magnesium sulfate, or mixtures thereof.

Boric acid may alternatively be included in the zinc plating bath of the invention as a weak buffer to control the pH. The boric acid also is helpful in smoothing the deposit. The concentration of boric acid in the bath is not critical and generally will be in the range of up to about 40 grams per liter.

The acidity of the acid baths of the invention may vary from a pH of about 1.5 to about 6 or 7. The pH may be lowered by the addition of acid solutions such as dilute hydrochloric or sulfuric acid solutions. If the pH falls below the desired operating range it can be increased by the addition of ammonium hydroxide or potassium hydroxide. Preferably the acid zinc baths are operated at a pH of from about 4 to about 6.5.

The inorganic salts of zinc may be present in the plating baths of the invention in amounts ranging from about 10 to 150 grams per liter preferably, 30 to 110. The conductive salts such as ammonium or potassium chloride are present in amounts ranging from about 50 to 250 grams per liter or more.

Of course, the bath may also include any desirable additional additives as are conventional including brighteners, wetting agents, etc. The acid zinc electroplating baths may be used to produce bright zinc deposits on all types of metals and alloys, for example, iron, copper and brass.

Generally, other substances which have been found to exhibit secondary brightening action can be utilized including surfactants or wetting agents such as known materials like polyvinyl alcohol, gelatin, carboxymethyl cellulose, non-ionic polymerics and heterocyclic quaternaries and the like. If desired, chelating agents can be included such as, for example, citric acid and maleic acid to prevent the precipitation of zinc compounds either in the body of the plating bath or on the surfaces of the anode or cathode. These chelating agents also serve to provide buffering action in the bath.

Organic brighteners may include acetothionapthene, fluorolacetone, benzalacetone, benzophenone, benzoacetonitrile, and orthochlorobenzaldehyde. Alternative brightening agents of the types typically employed in zinc alloy plating solutions include aromatic aldehydes or ketones, nicotinate quaternaries, polyepichloralhydrin quanternaries with amines, polyethylene amines and their derivatives, thioureas or N substituted derivatives thereof.

In addition, aluminum ion can be introduced into the bath by an aqueous soluble salt thereof such as aluminum sulfate, to obtain and enhance brightening effect. Similarly, corrosion resistance can be enhanced by the addition of small amounts of trace metals which will co-deposit with the zinc alloy. For example, soluble salts of chromium, tin or indium may be added to the baths. It will be appreciated that the operating conditions, such as temperature and current density under which the plating baths of this invention are employed, may vary depending on the particular bath composition on the nature of the metal surface to be plated.

The zinc electroplating process may be carried out at temperatures of about 10° C. to 50° C. and preferably between 15° C. to 35° C. either with or without agitation. If necessary, agitation of the plating bath can be provided either by mechanical movement or the article being plated by solution agitation during the electro-deposition.

In a particularly preferred form, the present invention includes an additive of the following general formula:

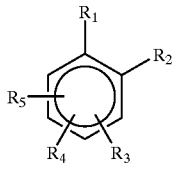

wherein $R_1$ and $R_2$ are selected from the following functional groups hydroxyl, carbonyl, carboxylic acid or its salt; $R_3$ is selected from the following groups hydrogen, hydroxyl, carbonyl, carboxylic acid or its salts; $R_4$ and $R_5$ are electron withdrawing groups, such as but not totally inclusive, halides, sulfonic acid or its salts, triflouromethyl, cyano, and amino groups.

In a particularly preferred form of the invention, the additive will comprise dodecyl (sulfophenoxy) benzene sulfonic acid disodium salt or 4,5-dihydroxy-1,3-benzene disulfonate disodium salt.

An important attribute of the present invention includes the adjacent positioning of the hydroxy or carboxylic acid groups on the benzene ring. Without being bound by theory, it is believed the inventive compounds may function to slow the deposition of zinc in the high current density areas, leading to a more uniform coating. This strategy is divergent from traditional practice wherein compounds such as pyrolidones have been used which are believed to absorb to the part in the high current density areas to slow the coating process in that region.

The following examples illustrate the inventive additives of the invention.

EXAMPLES

Various additives for improving the throwing power of an acid-zinc chloride plating bath, was added to a plating bath with the composition given in the following table.

| Bath Component | Concentration |
|---|---|
| Zinc Chloride | 47 g/l |
| Potassium Chloride | 135 g/l |
| Ammonium Chloride | 45 g/l |
| AmeriZinc Zcl $NH_4$ Starter | 40 ml/l |
| AmeriZinc BRT II Brightener | 1 ml/l |

The starter and brightener are commercially available from Pavco, Inc. of Cleveland, Ohio. All plating was performed at 23 to 27° C. and unless otherwise stated, the pH of the plating bath was 5.7–5.9. Plating evaluations were conducted in a 267 ml Hull cell panel with a zinc anode and a steel cathode. The Hull cell panels were pickled in 50% hydrochloric acid just prior to plating. During plating, the cell current was controlled at one ampere for fifteen minutes or at two amperes for five minutes.

Thickness measurements were made using a CMI International Corp., Model EMX-D thickness tester equipped with an eddy current probe. Thickness readings were made at a high-current density (HCD) and a low-current density (LCD) regions of the Hull cell panel. The LCD and HCD regions of a one-ampere panel correspond to a current density of 0.3–0.4 and 3–4 amperes/square decimeter, respectively, while the LCD and HCD regions of a two ampere panel correspond to a current density of 0.6–0.8 and 6–9 amperes/square decuneterm respectively. At each current density, 6–10 individual thickness measurements were made and then averaged.

The throwing power of the plating bath was determined from the ratio of the HCD/LCD thickness reading, and the effect of the additive can be determined by comparing the HCD/LCD ratios of panels prepared from the various additive baths to the HCD/LCD ratio of control baths. The various additives, plating conditions, and corresponding throwing power are listed in the following table.

| Chemical Class or Compound | Manufacturer | Compound Trade Name | Concentration in Plating Bath (g/l) | pH of Plating Bath | 5 minutes @ 2A HOD | 5 minutes @ 2A LOD | 5 minutes @ 2A HOD/LOD | 15 minutes @ 1A HOD | 15 minutes @ 1A LOD | 15 minutes @ 1A HOD/LOD |
|---|---|---|---|---|---|---|---|---|---|---|
| Polyethylene Glycol | Union Carbide | Carbowax 1540 | 0 | | 0.63 | 0.13 | 4.8 | | | |
| | | | 2 | | 0.62 | 0.14 | 4.4 | | | |
| | | | 10 | | 0.63 | 0.14 | 4.5 | | | |
| | | | 20 | | 0.63 | 0.15 | 4.2 | | | |
| Polyquatermium | Rhone-Poulenc | Mirapol A-15 | 0 | | 0.65 | 0.13 | 5.0 | | | |
| | | | 1 | | 0.63 | 0.13 | 4.8 | | | |
| | | | 5 | | 0.63 | 0.13 | 4.8 | | | |
| | | | 10 | | 0.62 | 0.13 | 4.8 | | | |
| Polyvinyl Alcohol | Air Products | Airvol 603 | 0 | | 0.64 | 0.14 | 4.6 | | | |
| | | | 0 | | 0.64 | 0.13 | 4.9 | | | |
| | | | 2 | | 0.62 | 0.13 | 4.8 | | | |
| | | | 4 | | 0.61 | 0.13 | 4.7 | | | |
| Tetramethylammonium Chloride | Aldrich | | 0 | | 0.67 | 0.13 | 5.2 | | | |
| | | | 1 | | 0.64 | 0.14 | 4.6 | | | |
| | | | 5 | | 0.64 | 0.12 | 5.3 | | | |
| | | | 10 | | 0.64 | 0.14 | 4.6 | | | |
| Xantham Gum | Kelco | Kelzan S | 0 | | 0.68 | 0.11 | 6.2 | | | |
| | | | 0.00 | | 0.69 | 0.12 | 5.8 | | | |
| | | | 0.01 | | 0.62 | 0.13 | 4.8 | | | |
| | | | 0.04 | | 0.70 | 0.15 | 4.7 | | | |
| | | | 0.05 | | 0.64 | 0.13 | 4.9 | | | |
| | | | 0.10 | | 0.63 | 0.14 | 4.5 | | | |
| | | | 0.20 | | 0.73 | 0.16 | 4.6 | | | |
| | | | 0.40 | | 0.87 | 0.15 | 5.8 | | | |

-continued

| Chemical Class or Compound | Manufacturer | Compound Trade Name | Concentration in Plating Bath (g/l) | pH of Plating Bath | 5 minutes @ 2A HOD | 5 minutes @ 2A LOD | 5 minutes @ 2A HOD/LOD | 15 minutes @ 1A HOD | 15 minutes @ 1A LOD | 15 minutes @ 1A HOD/LOD |
|---|---|---|---|---|---|---|---|---|---|---|
| Polyvinylpyrrolidone | ISP Technologies, Inc. | PVP K15 | 0 | | 0.66 | 0.13 | 5.1 | | | |
| | | | 0 | | 0.66 | 0.13 | 5.1 | | | |
| | | | 0.4 | | 0.58 | 0.13 | 4.5 | | | |
| | | | 0.4 | | 0.59 | 0.14 | 4.2 | | | |
| | | | 2.0 | | 0.52 | 0.13 | 4.0 | | | |
| | | | 2.0 | | 0.57 | 0.14 | 4.1 | | | |
| | | | 4.0 | | 0.50 | 0.13 | 3.8 | | | |
| | | | 4.0 | | 0.53 | 0.13 | 4.1 | | | |
| Polyvinylpyrrolidone | ISP Technologies, Inc. | PVP K-30 | 0 | | 0.65 | 0.11 | 5.9 | | | |
| | | | 0.2 | | 0.60 | 0.12 | 5.0 | | | |
| | | | 1.0 | | 0.52 | 0.11 | 4.7 | | | |
| | | | 2.0 | | 0.46 | 0.11 | 4.2 | | | |
| Polyvinylpurrolidone | ISP Technologies, Inc. | PVP K-60 Solution | 0 | | 0.60 | 0.12 | 5.0 | | | |
| | | | 0.4 | | 0.53 | 0.11 | 4.8 | | | |
| | | | 2.0 | | 0.46 | 0.10 | 4.6 | | | |
| | | | 4.0 | | 0.42 | 0.10 | 4.2 | | | |
| Vinylpyrrolidone Vinylacetate Copolymer | ISP Technologies, Inc | PVP/VA E-535 | 0 | | 0.49 | 0.09 | 5.4 | 0.78 | 0.17 | 4.6 |
| | | | 0.4 | | 0.45 | 0.07 | 6.4 | 0.77 | 0.12 | 6.4 |
| | | | 2.0 | | 0.51 | 0.09 | 5.7 | 0.68 | 0.13 | 5.2 |
| | | | 4.0 | | 0.42 | 0.09 | 4.7 | 0.59 | 0.14 | 4.2 |
| Polyethoxylated Polyaryphenol | Rhone-Poulenc | Soprophor S/25 | 0 | | 0.63 | 0.11 | 5.7 | | | |
| | | | 0.4 | | 0.61 | 0.12 | 5.1 | | | |
| | | | 2.0 | | 0.56 | 0.13 | 4.3 | | | |
| | | | 4.0 | | 0.52 | 0.13 | 4.0 | | | |
| Polyvinylpyrrolidone | BASF | Luviskol K30 | 0 | | 0.57 | 0.13 | 4.4 | 0.61 | 0.17 | 3.6 |
| | | | 0.4 | | 0.49 | 0.12 | 4.1 | 0.55 | 0.17 | 3.2 |
| | | | 2.0 | | 0.38 | 0.10 | 3.8 | 0.48 | 0.16 | 3.0 |
| | | | 4.0 | | 0.33 | 0.10 | 3.3 | 0.45 | 0.14 | 3.2 |
| Propargl-3-Sulfopropylether Sodium Salt | Raschig | POPS-Na | 0 | | 0.53 | 0.09 | 5.9 | 0.78 | 0.15 | 5.2 |
| | | | 0.4 | | 0.52 | 0.10 | 5.2 | 0.73 | 0.16 | 4.6 |
| | | | 2.0 | | 0.52 | 0.10 | 5.2 | 0.73 | 0.15 | 4.9 |
| | | | 4.0 | | 0.50 | 0.09 | 5.6 | 0.70 | 0.15 | 4.7 |
| Reaction Product of 1,4-Butyne Diole, Propane Sulfone, Sodium Hydroxide | Raschig | HBOPS-Na | 0 | | 0.63 | 0.10 | 6.3 | 0.80 | 0.18 | 4.4 |
| | | | 0.4 | | 0.61 | 0.10 | 6.1 | 0.80 | 0.17 | 4.7 |
| | | | 2.0 | | 0.57 | 0.09 | 6.3 | 0.72 | 0.13 | 5.5 |
| | | | 4.0 | | 0.55 | 0.11 | 5.0 | 0.70 | 0.17 | 4.1 |
| Ethoxylated Dodecyl Mercaptan | Rhone-Poulenc | Alcodet SK | 0 | | 0.66 | 0.13 | 5.1 | 0.90 | 0.16 | 5.6 |
| | | | 0.4 | | 0.66 | 0.12 | 5.5 | 0.86 | 0.22 | 3.9 |
| | | | 2.0 | | 0.57 | 0.10 | 5.7 | 0.81 | 0.18 | 4.5 |
| | | | 4.0 | | 0.54 | 0.11 | 4.9 | 0.71 | 0.16 | 4.4 |
| Dodecylthioethoxylate | Rhone-Poulenc | Alcodet HSC-1000 | 0 | | 0.60 | 0.10 | 6.0 | 0.82 | 0.17 | 4.8 |
| | | | 0.4 | | 0.58 | 0.13 | 4.5 | 0.80 | 0.18 | 4.4 |
| | | | 2.0 | | 0.58 | 0.12 | 4.8 | 0.71 | 0.16 | 4.4 |
| | | | 4.0 | | 0.52 | 0.10 | 5.2 | 0.66 | 0.15 | 4.4 |
| Ethoxylated Dodecyl Mercaptan | Rhone-Poulenc | Alcodet 218 | 0 | | 0.66 | 0.12 | 4.7 | 0.85 | 0.17 | 5.0 |
| | | | 0.4 | | 0.57 | 0.13 | 4.4 | 0.77 | 0.13 | 5.9 |
| | | | 2.0 | | 0.53 | 0.12 | 4.4 | 0.66 | 0.15 | 4.4 |
| | | | 4.0 | | 0.54 | 0.12 | 4.5 | 0.67 | 0.19 | 3.5 |
| Dodecylthioethoxylate | Rhone-Poulenc | Alcodet IL-3500 | 0 | | 0.62 | 0.13 | 4.8 | 0.77 | 0.13 | 5.9 |
| | | | 0.4 | | 0.58 | 0.13 | 4.5 | 0.78 | 0.15 | 5.2 |
| | | | 2.0 | | 0.56 | 0.11 | 5.1 | 0.68 | 0.18 | 3.8 |
| | | | 4.0 | | 0.51 | 0.12 | 4.3 | 0.61 | 0.21 | 2.9 |
| Dodecyl Thioethyoxylate | Rhone-Poulenc | Alcodet TX-4000 | 0 | | 0.61 | 0.13 | 4.7 | 0.79 | 0.13 | 6.1 |
| | | | 0.4 | | 0.57 | 0.12 | 4.8 | 0.78 | 0.19 | 4.1 |
| | | | 2.0 | | 0.57 | 0.11 | 5.2 | 0.76 | 0.19 | 4.0 |
| | | | 4.0 | | 0.53 | 0.14 | 4.1 | 0.70 | 0.20 | 3.5 |
| Dodecyl Thioethoxylate | Rhone-Poulenc | Alcodet MC-2000 | 0 | | 0.58 | 0.13 | 4.5 | 0.85 | 0.18 | 4.7 |
| | | | 0.4 | | 0.52 | 0.12 | 4.3 | 0.77 | 0.18 | 4.3 |
| | | | 2.0 | | 0.53 | 0.11 | 4.8 | 0.65 | 0.16 | 4.1 |
| | | | 4.0 | | 0.55 | 0.14 | 3.9 | 0.63 | 0.17 | 3.7 |
| Ethoxylated Dodecyl Mercaptan | Rhone-Poulenc | Alcodet 260 | 0 | | 0.57 | 0.11 | 5.2 | 0.77 | 0.15 | 5.1 |
| | | | 0.4 | | 0.59 | 0.11 | 5.4 | 0.76 | 0.16 | 4.8 |
| | | | 2.0 | | 0.64 | 0.13 | 4.9 | 0.74 | 0.16 | 4.6 |
| | | | 4.0 | | 0.53 | 0.12 | 4.4 | 0.69 | 0.19 | 3.6 |
| Quaternized Vinylpyrrolidone Dimethylaminoethyl Methacrylate Copolymer | ISP Technologies, Inc. | Gafquat 734 | 0 | | 0.42 | 0.14 | 3.0 | 0.57 | 0.18 | 3.2 |
| | | | 0.4 | | 0.40 | 0.14 | 2.9 | 0.51 | 0.16 | 3.2 |
| | | | 2.0 | | 0.34 | 0.13 | 2.6 | 0.41 | 0.13 | 3.2 |
| | | | 4.0 | | 0.28 | 0.12 | 2.3 | 0.39 | 0.16 | 2.4 |

-continued

| Chemical Class or Compound | Manufacturer | Compound Trade Name | Concentration in Plating Bath (g/l) | pH of Plating Bath | 5 minutes @ 2A HOD | 5 minutes @ 2A LOD | 5 minutes @ 2A HOD/LOD | 15 minutes @ 1A HOD | 15 minutes @ 1A LOD | 15 minutes @ 1A HOD/LOD |
|---|---|---|---|---|---|---|---|---|---|---|
| Quaternized Vinylpyrrolidone | ISP Technologies, | Gafquat 755 | 0 | | 0.43 | 0.14 | 3.1 | 0.65 | 0.19 | 3.4 |
| Dimethylaminoethyl | Inc. | | 0.4 | | 0.42 | 0.15 | 2.8 | 0.58 | 0.17 | 3.4 |
| Methacrylate Copolymer | | | 2.0 | | 0.38 | 0.13 | 2.9 | 0.47 | 0.16 | 2.9 |
| | | | 4.0 | | 0.37 | 0.12 | 3.1 | 0.48 | 0.16 | 3.0 |
| Quaternized Vinylpyrrolidone | ISP Technologies, | Gafquat | 0 | | 0.42 | 0.13 | 3.2 | 0.55 | 0.16 | 3.4 |
| Dimethlaminoethyl | Inc. | 755N | 0.4 | | 0.41 | 0.15 | 2.7 | 0.55 | 0.16 | 3.4 |
| Methacrylate Copolymer | | | 2.0 | | 0.38 | 0.12 | 3.2 | 0.51 | 0.16 | 3.2 |
| | | | 4.0 | | 0.35 | 0.12 | 2.9 | 0.46 | 0.14 | 3.3 |
| Vinylpyrrolidone | ISP Technologies, | Gafquat | 0 | | 0.40 | 0.15 | 2.7 | 0.55 | 0.15 | 3.7 |
| Methacrylamidopropyl | Inc. | HS-100 | 0.4 | | 0.39 | 0.14 | 2.8 | 0.52 | 0.16 | 3.3 |
| Trimethylammonium Chloride | | | 2.0 | | 0.39 | 0.13 | 3.0 | 0.51 | 0.15 | 3.4 |
| Copolymer | | | 4.0 | | 0.35 | 0.12 | 2.9 | 0.45 | 0.15 | 3.0 |
| Polyethyleneimine | BASF | Lugalvan | 0 | | 0.39 | 0.09 | 4.3 | 0.57 | 0.16 | 3.6 |
| | | G20 | 1 | | 0.31 | 0.06 | 3.9 | 0.47 | 0.11 | 4.3 |
| | | | 5 | | 0.27 | 0.07 | 3.9 | 0.40 | 0.11 | 3.6 |
| | | | 10 | | 0.26 | 0.08 | 3.3 | 0.39 | 0.14 | 2.8 |
| Polyethyleneimine | BASF | Lugalvan | 0 | | 0.40 | 0.12 | 3.3 | 0.57 | 0.15 | 3.8 |
| | | G35 | 1 | | 0.31 | 0.11 | 2.8 | 0.42 | 0.12 | 3.5 |
| | | | 5 | | 0.28 | 0.11 | 2.5 | 0.37 | 0.16 | 2.3 |
| | | | 10 | | 0.25 | 0.11 | 2.3 | 0.38 | 0.13 | 2.9 |
| Dodecyl(Sulfophenoxy) | Rhone-Poulenc | Rodacal | 0 | | 0.38 | 0.04 | 9.5 | 0.43 | 0.06 | 7.2 |
| Benzenesulfonic Acid | | DSB | 1 | | 0.41 | 0.05 | 8.2 | 0.43 | 0.09 | 4.8 |
| Disodium Salt | | | 5 | | 0.36 | 0.05 | 7.2 | 0.40 | 0.11 | 3.6 |
| | | | 10 | | 0.30 | 0.09 | 3.3 | 0.29 | 0.08 | 3.6 |
| Polyethoxylated | Rhone-Poulenc | Soprophor | 0 | | 0.33 | 0.04 | 8.3 | 0.49 | 0.05 | 9.8 |
| Polyarylphenol | | 3033 | 1 | | 0.34 | 0.04 | 8.5 | 0.35 | 0.07 | 5.0 |
| Phosphate | | | 5 | | 0.28 | 0.03 | 9.3 | 0.34 | 0.02 | 17.0 |
| | | | 10 | | 0.29 | 0.02 | 14.5 | 0.25 | 0.05 | 5.0 |
| Sulfated Polyarylphenol | Rhone-Poulenc | Soprophor | 0 | | 0.43 | 0.03 | 14.3 | 0.36 | 0.03 | 12.0 |
| Ethoxylate | | 4D384 | 1 | | 0.28 | 0.04 | 7.0 | 0.29 | 0.06 | 4.8 |
| | | | 5 | | 0.34 | 0.04 | 8.5 | 0.29 | 0.06 | 4.8 |
| | | | 10 | | 0.28 | 0.02 | 14.0 | 0.25 | 0.03 | 8.3 |
| 4,5-Dihydroxynapthaline-2,7- | Aldrich | | 0 | | 0.43 | 0.05 | 8.6 | 0.59 | 0.13 | 4.5 |
| disulfonic acid | | | 128 | | 0.45 | 0.06 | 7.5 | 0.69 | 0.07 | 9.9 |
| 4,5-Dihydroxy-1,4- | Aldrich | | 0 | 5.70 | 0.54 | 0.07 | 8.3 | | | |
| Benzenedisulfonic Acid, | | | 30 | | 0.28 | 0.05 | 5.5 | | | |
| Disodium Salt Monohydrate | | | 60 | | 0.23 | 0.05 | 4.5 | | | |
| | | | 90 | 4.50 | 0.18 | 0.06 | 2.9 | | | |
| | | | 90 | 5.00 | 0.20 | 0.06 | 3.6 | | | |
| | | | 90 | 5.50 | 0.31 | 0.05 | 6.2 | | | |
| | | | 90 | 6.10 | 0.36 | 0.07 | 5.5 | | | |
| | | | 120 | 4.20 | 0.20 | 0.06 | 3.3 | | | |
| | | | 120 | 4.50 | 0.18 | 0.07 | 2.7 | | | |
| | | | 120 | 4.75 | 0.14 | 0.06 | 2.5 | | | |
| | | | 120 | 5.00 | 0.20 | 0.06 | 3.6 | | | |
| | | | 120 | 5.50 | 0.33 | 0.06 | 6.0 | | | |
| | | | 120 | 6.00 | 0.36 | 0.07 | 5.1 | | | |
| | | | 120 | 6.50 | 0.32 | 0.09 | 3.6 | | | |
| | | | 120 | 6.50 | 0.32 | 0.09 | 3.7 | | | |
| | | | 120 | 7.00 | 0.33 | 0.10 | 3.3 | | | |
| Picolinic Acid | Charkit Chemical | | 0 | 5.0 | 0.43 | 0.08 | 5.4 | 0.61 | 0.13 | 4.7 |
| | Corp. | | 0 | 6.0 | 0.49 | 0.06 | 8.2 | 0.63 | 0.10 | 6.3 |
| | | | 0 | 6.0 | 0.54 | 0.06 | 9.0 | 0.59 | 0.13 | 4.5 |
| | | | 11.1 | 5.0 | 0.32 | 0.07 | 4.6 | 0.43 | 0.11 | 3.9 |
| | | | 11.1 | 6.0 | 0.35 | 0.06 | 5.8 | 0.41 | 0.09 | 4.6 |
| | | | 11.1 | 6.5 | 0.37 | 0.05 | 7.4 | 0.42 | 0.10 | 4.2 |
| N,N.N',N'-Tetrakis-(2- | BASF | Quadrol | 0 | 5.0 | 0.43 | 0.08 | 5.4 | 0.61 | 0.13 | 4.7 |
| Hydroxypropyl)- | | Polyol | 0 | 6.0 | 0.49 | 0.06 | 8.2 | 0.63 | 0.10 | 6.3 |
| Ethelenediamine | | | 0 | 6.0 | 0.54 | 0.06 | 9.0 | 0.59 | 0.13 | 4.5 |
| | | | 26.3 | 5.0 | 0.36 | 0.08 | 4.5 | 0.49 | 0.14 | 3.5 |
| | | | 26.3 | 6.0 | 0.35 | 0.05 | 7.0 | 0.60 | 0.11 | 5.5 |
| | | | 26.3 | 6.5 | 0.40 | 0.06 | 6.7 | 0.59 | 0.14 | 4.1 |
| Methionine | Aldrich | | 0 | 5.5 | 0.50 | 0.08 | 6.3 | 0.65 | 0.16 | 4.1 |
| | | | 0 | 5.8 | 0.49 | 0.10 | 4.9 | 0.62 | 0.14 | 4.4 |
| | | | 0 | 6.0 | 0.58 | 0.13 | 4.5 | 0.66 | 0.17 | 3.9 |
| | | | 13.4 | 5.5 | 0.35 | 0.07 | 5.0 | 0.55 | 0.14 | 3.9 |
| | | | 13.4 | 5.8 | 0.35 | 0.09 | 3.9 | 0.56 | 0.14 | 4.0 |
| | | | 13.4 | 6.0 | 0.36 | 0.09 | 4.0 | 0.50 | 0.09 | 5.6 |

As can be noted, several of the bidendate chelate compounds provide evidence of increased throwing power as the ratio HCD to LCD is significantly reduced.

Thus, it is apparent that there has been provided in accordance with the invention, an acid zinc chloride plating bath that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations which fall within the spirit and scope of the appended claims.

What is claimed is:

1. An aqueous acid plating bath for the electro-deposition of a zinc or zinc alloy deposit on a substrate which includes;

i) zinc ions; and ii) an additive to increase throwing power of the general formula:

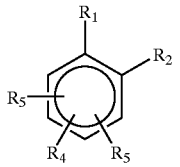

wherein $R_1$ and $R_2$ are selected from the following functional groups hydroxyl, carboxylic acid or its salt; $R_3$ is selected from the following groups hydrogen, hydroxyl, carboxylic acid or its salt; $R_4$ and $R_5$ are electron withdrawing groups selected from the group consisting of halides sulfonic acid or its salt, trifluoromethyl, and cyano.

2. The bath of claim 1 wherein $R_1$ and $R_2$ are each hydroxyl.

3. The bath of claim 1 wherein at least one of $R_4$ and $R_5$ is a sodium sulfonate.

4. The bath of claim 1 wherein $R_3$ is hydrogen.

5. The bath of claim 1 wherein said additive comprises 4, 5-dihydroxy-1,3-benzene disulfonate, disodium salt.

6. The bath of claim 1 wherein said additive comprises 4, 5-dihydroxy-1,3-benzene disulfonic acid, disodium salt monohydrate.

7. The bath of claim 1 further including a brightener.

8. The bath of claim 1 further including a starter.

9. The bath of claim 1 further including ammonium chloride.

10. A electro-deposition process of coating a metal article comprising immersing said metal article in a bath comprising zinc ions and an additive to increase throwing power of the general formula

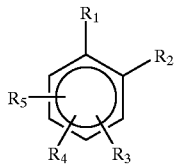

wherein $R_1$ and R2 are selected from the following functional groups hydroxyl, carboxylic acid or its salt; $R_1$ is selected from the following groups hydrogen, hydroxyl, carboxylic acid or its salt; $R_4$ and $R_5$ are electron withdrawing groups selected from the group consisting of halides, sulfonic acid or its salt, trifluorometyl and cyano.

11. The process of claim 10 wherein $R_1$ and $R_2$ are each hydroxyl.

12. The process of claim 10 wherein said bath further includes a sodium sulfonate group.

13. The process of claim 10 wherein said additive comprises 4,5-dihydroxy-1,3-benzene disulfonate, disodium salt.

14. The process of claim 10 wherein said additive comprises 4,5-dihydroxy-1,4-benzene disulfonic acid, disodium salt monohydrate.

15. The process of claim 10 further including a starter.

* * * * *